US005685119A

United States Patent [19]

Zschoppe

[11] Patent Number: 5,685,119

[45] Date of Patent: Nov. 11, 1997

[54] WALL CONSTRUCTION SYSTEM

[76] Inventor: Bodo Zschoppe, Strateweg 1, 32545 Bad Oeynhausen, Germany

[21] Appl. No.: 658,249

[22] Filed: Jun. 4, 1996

[51] Int. Cl.[6] ..... E04B 2/08; E04B 2/18; E04B 2/32; E04B 2/46

[52] U.S. Cl. ..... 52/592.5; 52/592.3; 52/590.3; 52/570

[58] Field of Search ..... 52/561, 568, 570, 52/590.2, 592.3, 592.5, 592.6, 503, 605

[56] References Cited

U.S. PATENT DOCUMENTS

| | | | |
|---|---|---|---|
| 2,610,503 | 9/1952 | Hall | 52/592.3 |
| 2,902,853 | 9/1959 | Lofstrom | 52/590.2 X |
| 4,115,980 | 9/1978 | Martel et al. | 52/590.2 |
| 4,473,985 | 10/1984 | Hunt | 52/503 X |
| 4,557,094 | 12/1985 | Beliveau | 52/570 X |
| 4,731,279 | 3/1988 | Isshiki | 52/592.3 X |
| 5,241,795 | 9/1993 | Giroux et al. | 52/503 X |
| 5,457,926 | 10/1995 | Jensen | 52/592.3 X |

*Primary Examiner*—Carl D. Friedman
*Assistant Examiner*—Yvonne Horton-Richardson
*Attorney, Agent, or Firm*—Henry M. Feiereisen

[57] ABSTRACT

A wall construction includes a plurality of shaped bricks for dry attachment to one another. Each said brick has a first bearing surface which includes a groove formed with a recess, and a second bearing surface in substantially parallel relationship to the first bearing surface and provided with a key which is formed with a projection, wherein the projection and the recess are complementarily shaped and positioned such that the projection of a first brick is engageable with the recess of a second brick when the second brick is stacked on the first brick for restraining displacement in a longitudinal direction of the second brick relative to the first brick. The bricks are formed with chases extending perpendicular to the first and second bearing surfaces and including a central channel and semitubular channels formed at opposing end faces of the brick.

10 Claims, 5 Drawing Sheets

WALL CONSTRUCTION SYSTEM

BACKGROUND OF THE INVENTION

The present invention refers to a wall construction system, and in particular to a wall construction system including a plurality of bricks having a first bearing surface formed with a groove, and a second bearing surface extending in substantially parallel relationship to the first bearing surface and formed with a key wherein the key and the groove are complementarily shaped and positioned such that the key of a first brick is engageable with the groove of a second brick when the second brick is stacked on the first brick.

Bricks of this type, which are laid down dry to form a wall, are known e.g. from German Pat. Nos. DE 14 09 139 as well as DE 27 01 771. The bricks include chases comprised of a central channel and open channels formed on opposing end faces perpendicular between the first and second surfaces for providing spaces to receive pipes, ducts, wiring or other structural elements. These conventional bricks have several disadvantages which prevent fabrication of a wall construction in an optimum fashion. One drawback is the lack of provisions to restrain joined or stacked bricks from shifting in a longitudinal direction. Even minor displacements, e.g. through accumulating foreign or dirt particles, may add up and reach such an extent that a precise bond and construction of the wall becomes impossible. In such a case, the foreign matter encountered between the butt joints of adjoining bricks results in leaky areas which adversely affect the finished wall construction, in particular with regard to the heat insulation.

Furthermore, the chases of conventional bricks are formed as continuous cavities so that at staggered pattern of laid bricks results in a channel of an upper brick being positioned on a subjacent brick above a channel which is disposed on the opposite end face. Upon use of only half a brick, e.g. when bounding a window opening or door opening, the material strength between both channels is practically halved, resulting in a significant weakening of the brick. This is especially important when this area assumes support function, e.g. for a window lintel or door lintel.

SUMMARY OF THE INVENTION

It is an object of the present invention to provide an improved wall construction system, obviating the aforestated drawbacks.

In particular, it is an object of the present invention to provide an improved wall construction system, which can be precisely laid in a simple manner and exhibits optimum load-receiving capability and an impeccable exterior face.

These objects, and others which will become apparent hereafter, are attained in accordance of the present invention by providing a shaped brick having a first bearing surface exhibiting a groove formed with a recess, and a second bearing surface provided with a key which includes a projection, wherein the projection and the recess are complementarily shaped and positioned such that the projection on a first brick is engageable with the recess of a second brick when the second brick is stacked on the first brick for restraining displacement in a longitudinal direction of the second brick relative to the first brick.

Through the provision of such a tongue and groove joint between stacked bricks, in accordance with the present invention, the bricks are restrained from shifting longitudinally, e.g. through foreign particles, so that a uniform look of the joints and thus of the finished masonry is effected. Moreover, a previously necessary finishing step of shortening the last brick of a row can be omitted.

Advantageously, a seal may be provided between bearing surfaces of opposing bricks and possibly between abutting end faces of neighboring bricks, with the seal between the bearing surfaces being of strip-like configuration and complementing the contour of the groove and the key, respectively. The seal may formed with a smooth or fluted surface.

In view of their soft consistency, dirt particles encountered on the support surfaces, can push into the seal, so that the laid pattern of the bricks is not changed in any significant way. The height of the key and the depth of the groove should be complemented to the strength of the seal.

It is of particular advantage to roll off a sealant strip or a sealant band from a supply reel for covering an entire layer of neighboring bricks. It is also possible to securely affix, e.g. by cementing, a seal directly on the brick at the manufacturers end. Typically, the bricks are however cemented to one another by automatically applying with a suitable applicator a thin bed bonding agent upon the surface of the bricks.

Suitably, at leveled configuration of the recesses and projections in relation to the pertaining grooves and keys the laying procedure of the bricks can be considerably rationalized.

According to another feature of the present invention, the bricks may include in the area of the abutting end faces vertical gaps which, after laying the bricks and formation of the wall, are injected with sealing compound, such as silicon or the like. Also conceivable is the use of sealant strips of suitable material.

According to still another feature of the present invention, the corner area of the wall construction are formed by quoins or corner elements exhibiting one smooth end face which to form a visible exterior surface.

In order to precisely arrange the butt joint of two bricks centrally above a subjacent brick that is placed in staggered disposition for generating a pleasing look, adapters or intermediate pieces are provided between a quoin and an angularly adjoining brick to thereby compensate any misalignment relative to the center between the groove of one end face and the key of the other end face of a brick.

The wall construction system according to the present invention allows formation of a wall in an extremely rapid and cost-efficient manner with optically pleasing exterior face.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
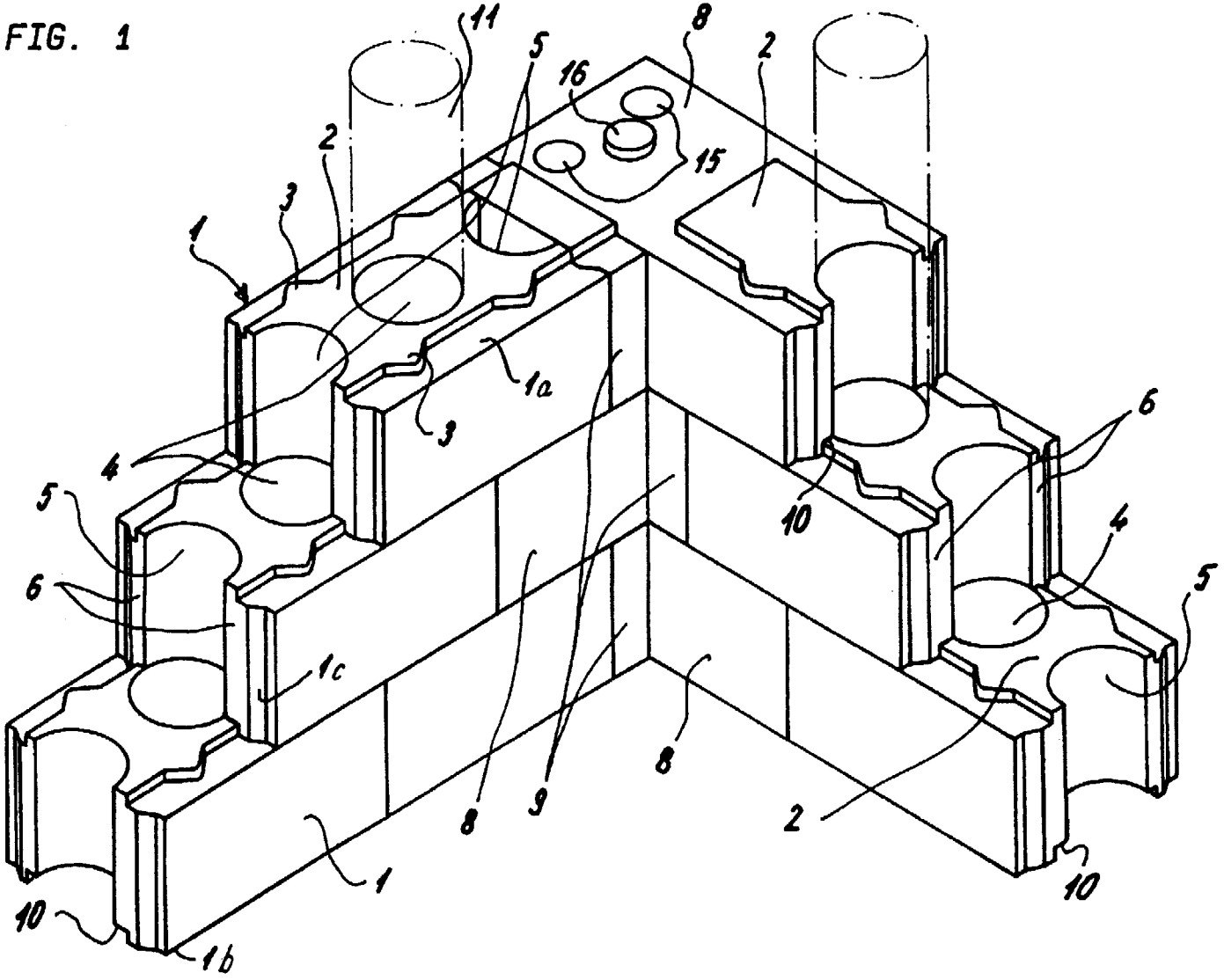
FIG. 1 is a fragmentary, perspective illustration of a corner area of a wall construction according to the present invention.

Throughout all the Figures, the same or corresponding elements are always indicated by the same reference numerals.

Referring now to the drawing, and in particular to FIG. 1, there is shown a fragmentary, perspective illustration of a corner area of a wall construction according to the present invention, formed substantially by a plurality of shaped bricks 1 stacked above each other and placed in end-to-end disposition. Each brick 1 exhibits first and second bearing surfaces 1*a*, 1*b* in parallel relationship, with bearing surface 1*a*, which represents the top side, exhibiting a key 2 which is formed with lateral projections 3. The bearing surface 1*b* represents the bottom side and includes a groove 10 which is formed with lateral recesses 12, as indicated e.g. in FIG. 3. The key 2 and the groove 10 have complementary contour to effect an interlocking connection of overlying bricks 1, with the key 2 being received in the groove 10 and the projections 3 engaging the recesses 12 so that stacked bricks 1 are restrained from a displacement in transverse as well as longitudinal directions.

Suitably, the projections 3 and the recesses 12 are in symmetric disposition with regard to the longitudinal and transverse axes.

Figure 2:
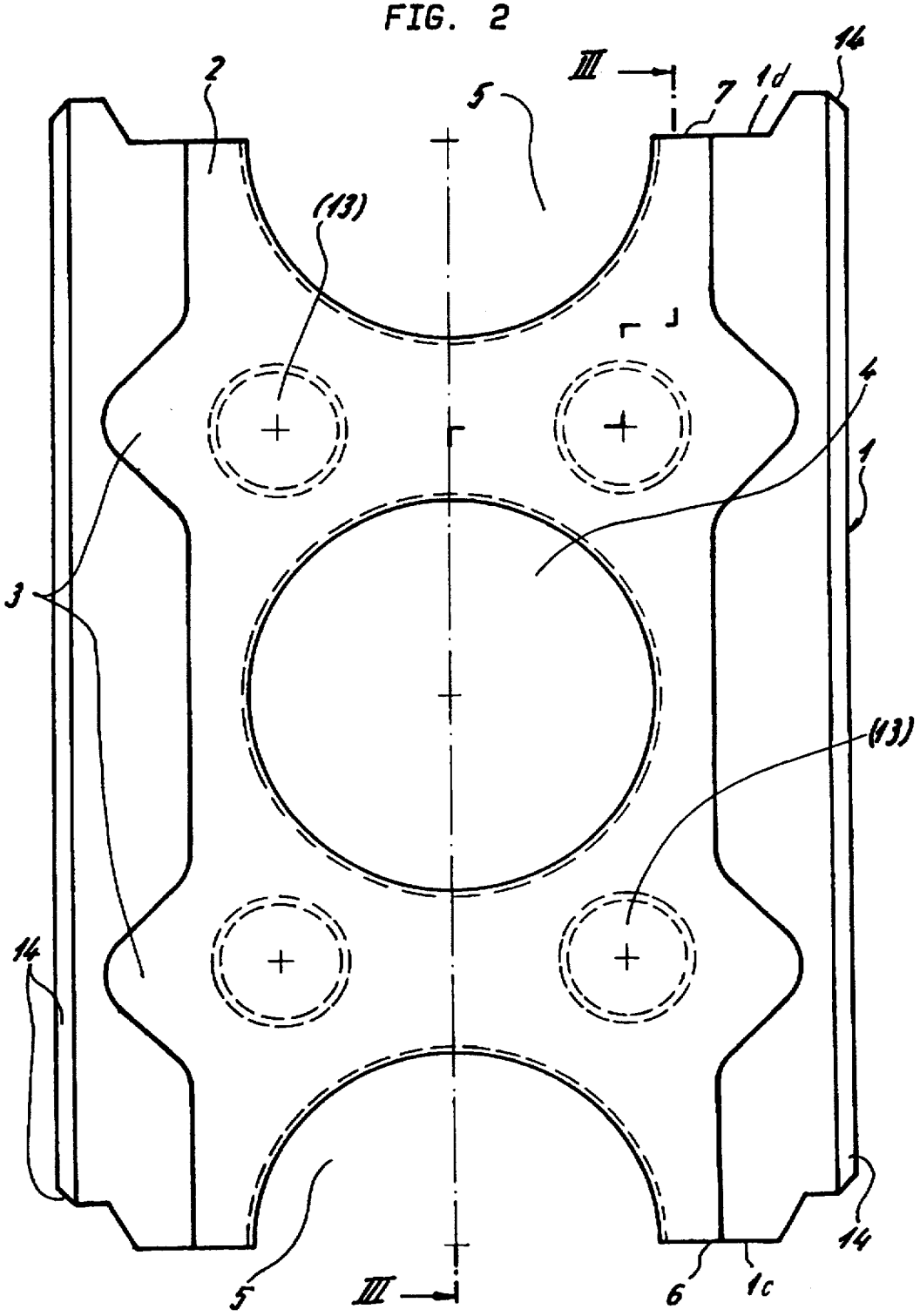
FIG. 2 is a top plan view of a shaped brick for use in the wall construction of FIG. 1.

As shown in FIG. 1 and in particular in FIG. 2, each brick 1 has end faces 1*c*, 1*d* which are formed with open semitubular channels 5. Further provided in the center of the brick 1 is a central channel 4. When stacking bricks 1 in staggered disposition, the channels 4 of the top brick coincide with abutting semitubular channels 5 of subjacent neighboring bricks 1 to provide the wall with continuous chases that form spaces for receiving posts 11, e.g. metal pipes, for securement in the base area to a subjacent ceiling and in the head area in order to meet static requirements.

Suitably, the end faces 1*c*, 1*d* of each brick 1 am further configured in such a manner that one end face 1*c* is formed with ribs or ridges 6 while the opposing end face 1*d* is formed with complementary grooves or indentations 7 (FIG. 2) to effect a form-fitting engagement when two bricks 1 are laid in end-to-end relationship. In this manner, the positional stability is enhanced and the joint between neighboring bricks 1 is closed to prevent any gaps through which one can look through.

Figure 4:
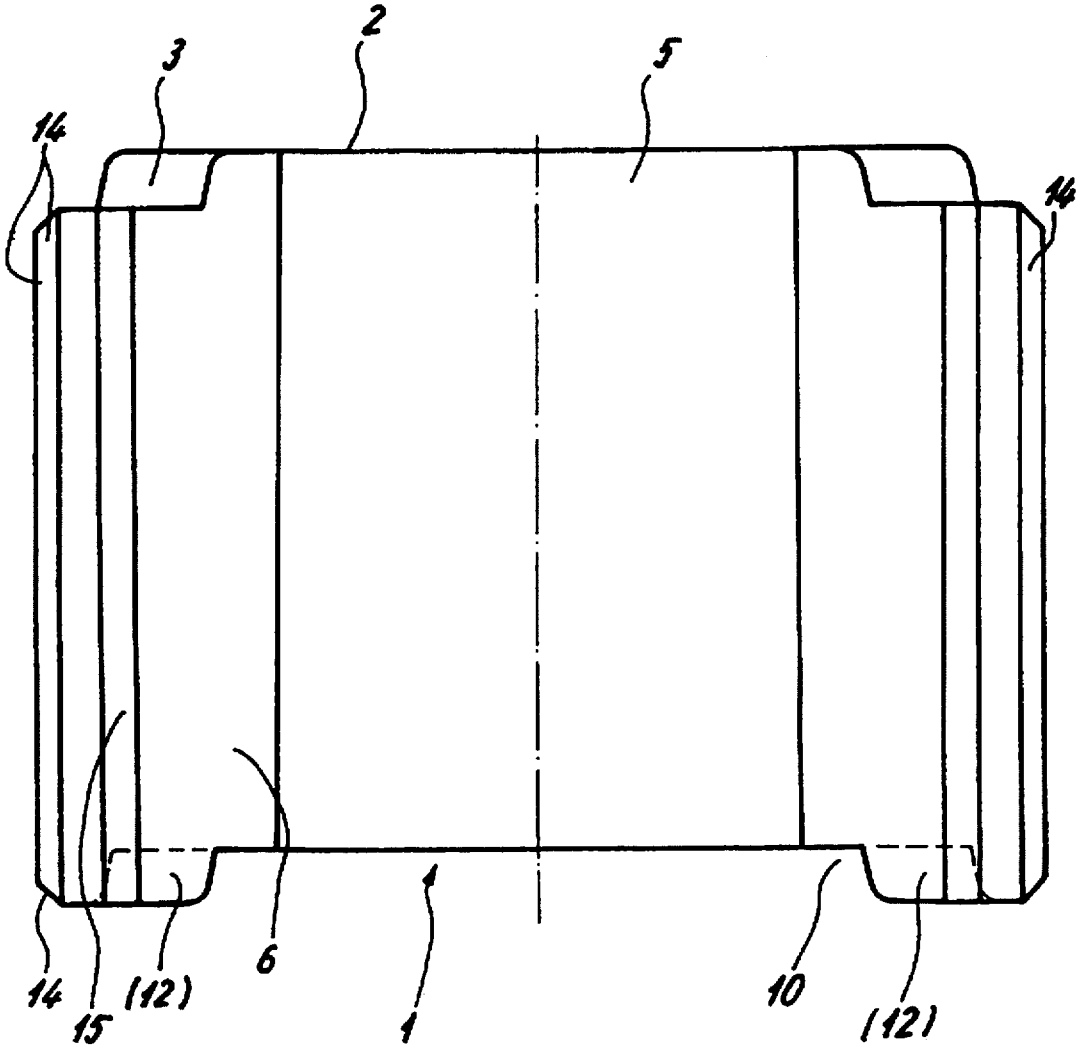
FIG. 4 is a front view of the brick.

As shown in FIG. 4, the outer edges 14 of the bricks 1 are chamfered to further enhance the overall look of the wall.

Figure 3:
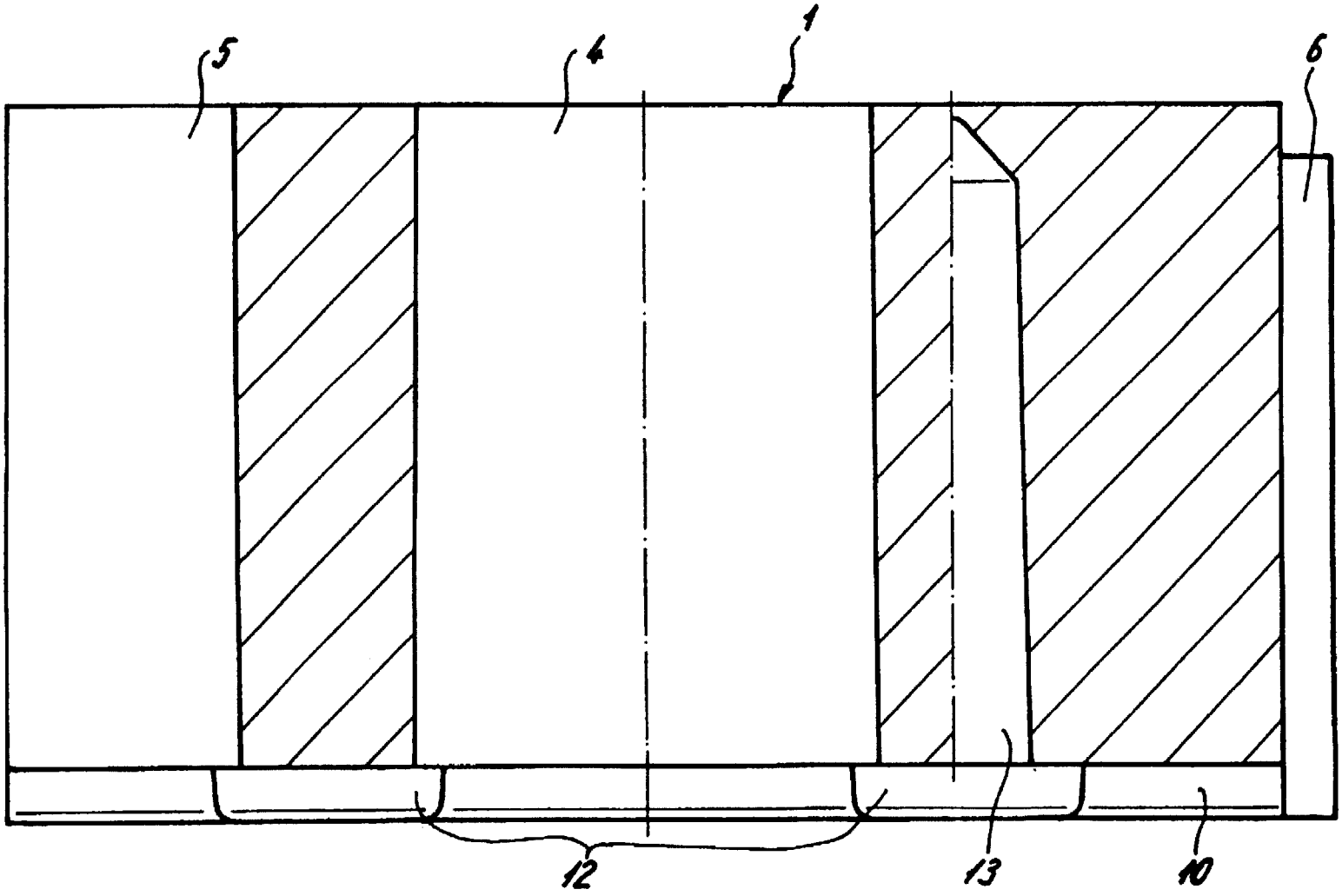
FIG. 3 is a sectional view of the brick taken along the line III—III in FIG. 2.

For reducing the overall weight, the bricks 1 include bores 13 in form of blind holes, as shown in FIGS. 3 and 4. However, the bores 13 are shown by way of example only, and may certainly configured as through-holes or bores of any cross sectional shape.

As further shown in FIG. 1, the wall construction system further includes quoins or corner elements 8 for placement in corner areas of the wall. The quoins 8 have a structure that essentially corresponds to the structure of the bricks 1, except that one of the end faces 1*c*, 1*d* is smooth and thus devoid of a semitubular channel so as to be suitable for use as an exterior face. Provided in vicinity of the smooth end face of the quoin 8 are bores 15 to provide spaces for additional reinforcing members over the entire wall height so as to be able to absorb the higher stress in the corner area.

A centering pin 16 is formed on the bearing surface 1*a* of the quoin 8 in an area adjacent the bores 15 for engagement in an indentation (not shown) formed in the bottom face 1*b* of an overlying quoin 8 to thereby effect a securement of stacked quoins 8.

In order to position the butt joint between two neighboring bricks 1 precisely in the middle over a subjacent brick 1 for creating a pleasing look, adapters or intermediate pieces 9 are placed in the corner area between a quoin 8 and a perpendicularly positioned adjacent brick 1 to fill any spaces created between the quoin 8 and the brick 1. The intermediate pieces 9 are provided with one smooth end face that abuts the side of a quoin 8 and with another end face that is formed with a rib or a groove for suitable form-fitting engagement with the end face of the brick 1.

Figure 5:
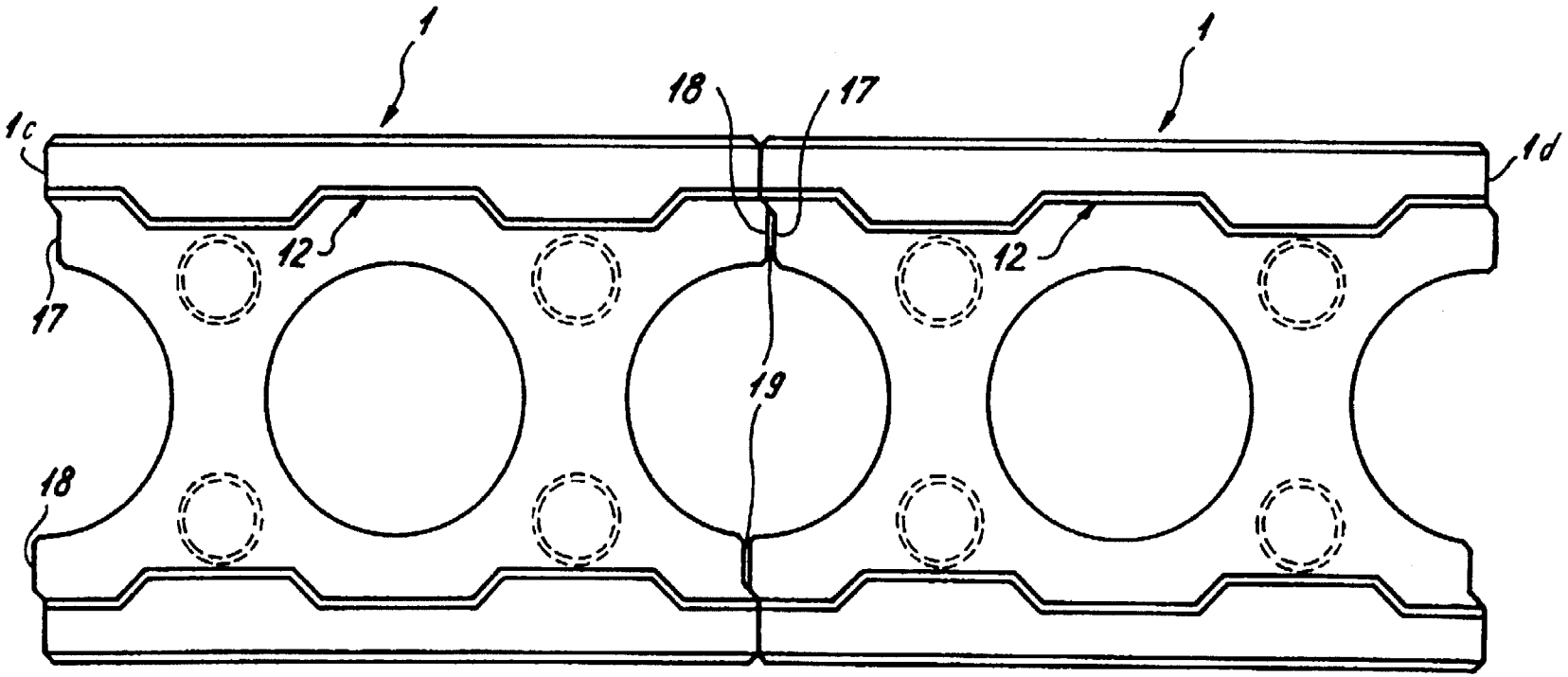
FIG. 5 is a fragmented top plan view of another embodiment of a wall construction according to the present invention; illustrating a joint between two bricks in end-to-end relationship.

Referring now to the FIG. 5, there is shown a fragmented top plan view of another embodiment of a wall construction according to the present invention, illustrating a connection between two bricks 1 with identical end faces 1*c*, 1*d* to facilitate handling of the bricks 1 during laying works. Each end face 1*c*, 1*d* of the brick 1 is formed with an indentation 17 and a ridge 18 which extend along the entire height of the end faces of the brick 1 so that the bricks 1 can be stacked regardless of which of the longitudinal sides represents the exposed exterior surface, i.e. the brick 1 can be turned in the plane by 180°.

Preferably, the depth of the indentation 17 slightly exceeds the height of the ridge 18 so that a gap 19 is formed that can be filled with cement or a sealing compound such as silicon.

While the invention has been illustrated and described as embodied in a wall construction system, it is not intended to be limited to the details shown since various modifications and structural changes may be made without departing in any way from the spirit of the present invention.

What is claimed as new and desired to be protected by Letters Patent is set forth in the appended claims:

1. A wall construction, comprising a plurality of shaped bricks joined in dry construction to one another, each brick having a first bearing surface which is provided with a groove formed laterally with a lateral recess, and a second bearing surface which is provided with a key formed laterally with a lateral projection, with the projection and the recess being complementarily shaped and positioned such that the projection on a first brick is engageable with the recess of a second brick when the second brick is stacked on the first brick for restraining displacement in a longitudinal direction of the second brick relative to the first brick, said brick being formed with chases extending perpendicular to the first and second bearing surfaces and including a central channel and semitubular channels at opposing end faces.

2. The wall construction of claim 1 wherein each brick defines a longitudinal axis and a transverse axis, said brick being formed with a plurality of such recesses and a plurality of such projections in symmetric relationship with regard to the longitudinal axis and the transverse axis.

3. The wall construction of claim 1 wherein each of the end faces of the brick has a first edge area formed with an indentation and a second edge area formed with a ridge which is complementarily shaped to the indentation.

4. The wall construction of claim 1 wherein one of the end faces has edge areas formed with an indentation, and the other one of the end faces has edge areas formed with a ridge which is complementarily shaped to the indentation.

5. The wall construction of claim 4 wherein the ridge has a height and the indentation has a depth which slightly exceeds the height of the ridge.

6. The wall construction of claim 5 wherein the ridge has a height and the indentation has a depth which slightly exceeds the height of the ridge.

7. The wall construction of claim 1, and further comprising a quoin for placement in a corner area of a wall, said quoin having one end face of smooth configuration.

8. The wall construction of claim 7, and further comprising an intermediate piece positioned between such a quoin and a brick adjoining the quoin at an angle thereto, said intermediate piece having an end face complementing the abutting one of the end faces of the brick, and a bearing surface complementing the abutting one of the bearing surfaces of the brick.

9. The wall construction of claim 8 wherein the brick, the quoin and the intermediate piece exhibit outer edges formed with a chamfer.

10. The wall construction of claim 8 wherein the quoin is formed with vertical bores in an area proximate to the smooth end face.

* * * * *